US009172198B2

(12) United States Patent
Yao et al.

(10) Patent No.: US 9,172,198 B2
(45) Date of Patent: Oct. 27, 2015

(54) CARD EDGE CONNECTOR WITH DETECTING STRUCTURE

(71) Applicant: HON HAI PRECISION INDUSTRY CO., LTD., New Taipei (TW)

(72) Inventors: Ze-Lin Yao, Kunshan (CN); Xiao-Zhi Fu, Kunshan (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 91 days.

(21) Appl. No.: 14/162,765

(22) Filed: Jan. 24, 2014

(65) Prior Publication Data

US 2014/0213085 A1 Jul. 31, 2014

(30) Foreign Application Priority Data

Jan. 29, 2013 (CN) ..... 2013 1 0033155

(51) Int. Cl.

| | |
|---|---|
| ***H01R 13/62*** | (2006.01) |
| ***H01R 43/26*** | (2006.01) |
| ***H01R 12/71*** | (2011.01) |
| ***H01R 13/703*** | (2006.01) |
| *H01R 13/627* | (2006.01) |
| *H01R 13/641* | (2006.01) |

(52) U.S. Cl.

CPC ..... *H01R 43/26* (2013.01); *H01R 12/712* (2013.01); *H01R 13/7031* (2013.01); *H01R 13/6275* (2013.01); *H01R 13/641* (2013.01); *Y10T 29/49222* (2015.01)

(58) Field of Classification Search

CPC .... H01R 43/26; H01R 12/712; H01R 13/641; H01R 13/7031

USPC ..... 439/157, 159, 160, 488, 489

See application file for complete search history.

(56) References Cited

U.S. PATENT DOCUMENTS

| | | | | |
|---|---|---|---|---|
| 7,708,599 | B2 * | 5/2010 | Guan et al. | 439/636 |
| 8,506,312 | B2 * | 8/2013 | Li et al. | 439/159 |
| 8,747,133 | B2 * | 6/2014 | Shen et al. | 439/160 |
| 8,858,257 | B2 * | 10/2014 | Mo et al. | 439/578 |
| 2007/0093097 | A1 * | 4/2007 | Guan et al. | 439/157 |

* cited by examiner

*Primary Examiner* — Khiem Nguyen

(74) *Attorney, Agent, or Firm* — Wei Te Chung; Ming Chieh Chang

(57) ABSTRACT

A card edge connector includes an ejector (3) with a pushing portion (32) extending from distal end thereof, the ejector (3) moves between an opening station and a locking station, and at least pair detecting contacts (4) which includes two detecting pins (41, 42), one of the detecting pins defines a spring engaging arm having an engaging portion (425) opposite to the pushing portion (32) which presses on the engaging portion (425) in the locking station or leave the engaging portion (425) in the opening station, thereby making the two detecting pins engage or disengage with each other for detecting if a memory card is inserted in the card edge connector or not.

20 Claims, 6 Drawing Sheets

CARD EDGE CONNECTOR WITH DETECTING STRUCTURE

BACKGROUND OF THE INVENTION

1. Field of the Invention

The present invention relates to a card edge connector, and more particularly to a card edge connector with detecting structure.

2. Description of the Related Art

Card edge connector is usually assembled on a mother board and then engages with a daughter board for interconnecting between the two boards. U.S. Pat. No. 7,922,506 issued to Harlan et al. on Apr. 12, 2011, discloses a card edge connector having an insulative housing and a plurality of contacts retained in the insulative housing. The insulative housing defines an inserting slot for receiving the daughter board. Each of the contacts includes a retaining portion retained in the sidewall, a contacting arm extending into the inserting slot from one end of the retaining portion for contacting with the daughter board and a soldering tail extending outwards to the insulative housing from another end of the retaining portion for connecting with and extending through the mother board. The contacting arms of the contacts are arranged in two rows in a width direction of the sidewall, respectively being received in two sidewalls disposed at both sides of the inserting slot.

However, if the daughter board is not inserted in the inserting slot correctly, the user can not be remaindered in time because of the daughter board has been disposed in an internal of the card edge connector.

Therefore, an improved card edge connector are desired to overcome the disadvantages of the related arts.

SUMMARY OF THE INVENTION

An object of the present invention is to provide a card edge connector with detecting function because of added detecting structure.

In order to achieve the above-mentioned object, a card edge connector for engaging with a memory card in accordance with a preferred embodiment of the present invention includes a longitudinal insulative housing having a pair of sidewalls and an inserting slot therebetween for receiving the memory card and a receiving opening communicating with the inserting slot, a plurality of contacts arranged two arrays along a longitudinal direction, an ejector being mounted into the receiving opening and comprising a pushing portion extending towards the insertion slot from distal end thereof, the ejector movably engages with the insulative housing and thus moves between an opening station in which the memory card is permitted inserted into or pushed outwards and a locking station in which the memory card is positioned in the inserting slot, and at least pair detecting contacts which includes a first detecting pin and a second detecting pin received and retained in corresponding receiving slots formed by the insulative housing, the second detecting pin defines a spring engaging arm having an engaging portion protruding to the insertion slot and opposite to the pushing portion which presses on the engaging portion in the locking station or leave the engaging portion in the opening station, thereby making the second detecting pin engage or disengage with the first detecting pin for detecting if the memory card is inserted in the card edge connector or not.

Other objects, advantages and novel features of the invention will become more apparent from the following detailed description of the present embodiment when taken in conjunction with the accompanying drawings.

DETAILED DESCRIPTION OF THE INVENTION

Figure 1:
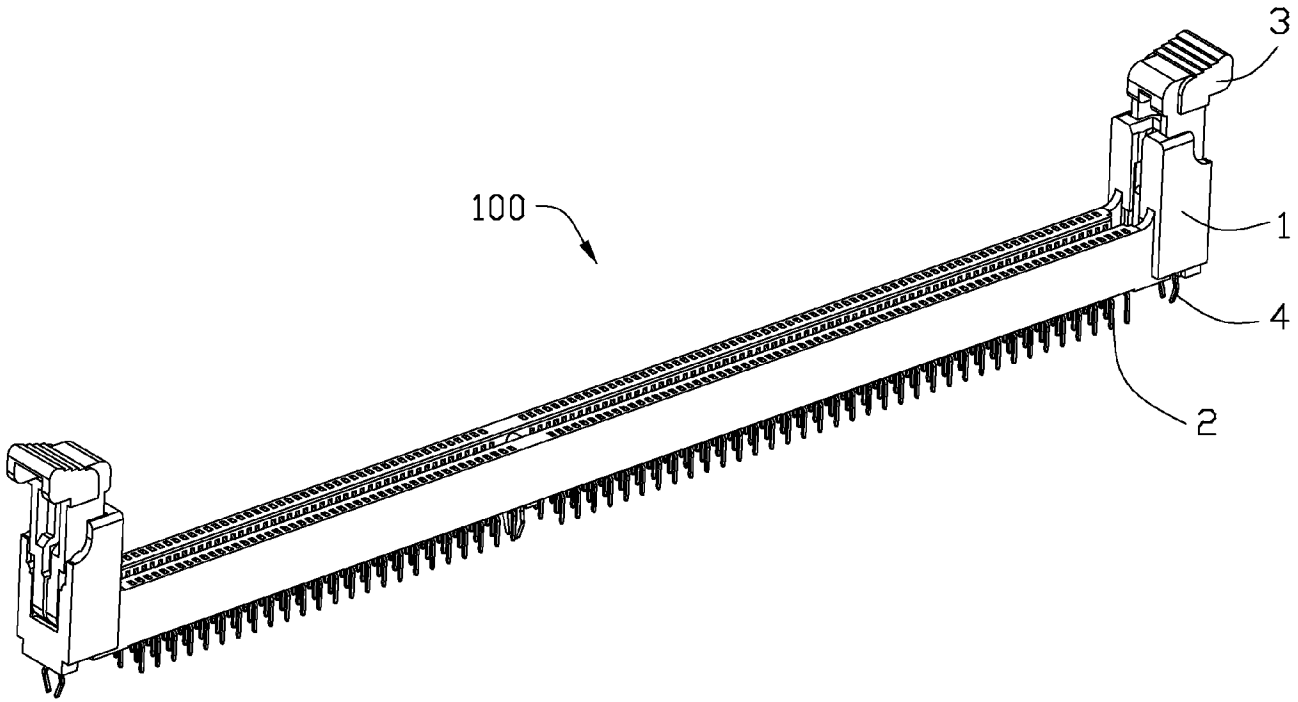
FIG. 1 is a perspective view of a card edge connector in accordance with the preferred embodiment of the present invention.

Reference will now be made to the drawing figures to describe the preferred embodiments of the present invention in detail.

Figure 2:
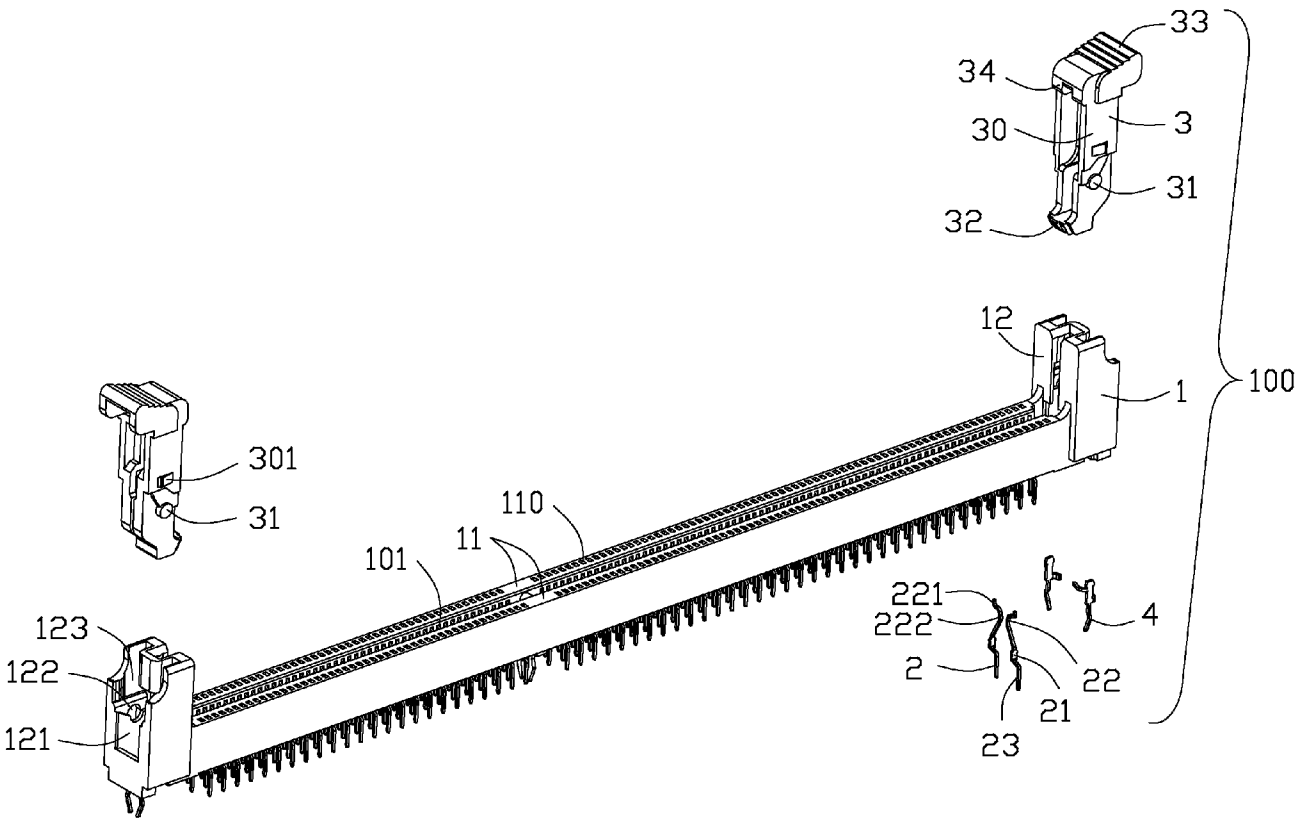
FIG. 2 is a partly exploded perspective view of the card edge connector of FIG. 1.

Referring to FIGS. 1 and 2, a card edge connector 100 is adapted to be mounted on a printed circuit board (PCB) (not shown) and then engage with a memory card (not shown) for interconnecting between both thereof. The card edge connector 100 includes a longitudinal insulative housing 1, a plurality of contacts 2 retained in the longitudinal insulative housing 1, an ejector 3 movably engaging with the insulative housing 1 and thus moving between an opening station in which the memory card is permitted inserted into or pushed outwards and a locking station in which the memory card is positioned in the card edge connector 100, and at least one pair of detecting contacts 4 retained in the insulative housing 1 for detecting whether the memory card is inserted into the card edge connector 100 or not.

The insulative housing 1 includes a pair of longitudinal sidewalls 11 opposite to each other in a width direction thereof and a pair of tower portions 12 upwards integrally protruding from both ends of the sidewalls 11, thereby forming an inserting slot 101 for receiving the memory card. The tower portion 12 has a receiving opening 121 for receiving the ejector 3 and an engaging recess 123 concaved from two opposite inner walls of the receiving opening 121 for locking the ejector 3 therein when the ejector 3 is disposed at the locking station. The ejector 3 is mounted into the receiving opening 121 and includes a base portion 30, a pair of rotating shafts 31 protruding from both sides of the base portion 30 and pivoting in a pair of shaft hole 122 formed by the tower portion 12, a pushing portion or kicker 32 extending towards the insertion slot 101 from one end of the base portion 30 in the opening station for pushing the memory card outwardly, an operating portion 33 disposed at distal end of the ejector 3 and a locking portion or locker 34 disposed at opposite end of the operating portion 33 and extending towards the insertion slot 101 from another end of the base portion 30 for locking the memory card.

The insulative housing 1 defines a plurality of receiving grooves 110 for receiving the contacts 2 therein. The contacts 2 are arranged two arrays along a longitudinal direction, while opposite to each other in the width direction, respectively being disposed at both sidewalls 11. Each of the contacts 2 includes a retaining portion 21 retained in the insulative housing 1, a contacting arm 22 extending into the inserting slot 13 upwardly from one end of the retaining portion 21 and having a protecting portion 221 engaging on receiving grooves 110 for limiting the contacting arm 22 moving overly and a first contacting portion 222 for contacting with the memory card and a soldering tail 23 extending outwards from another end of the retaining portion 21 for being soldered to the PCB.

Figure 3:
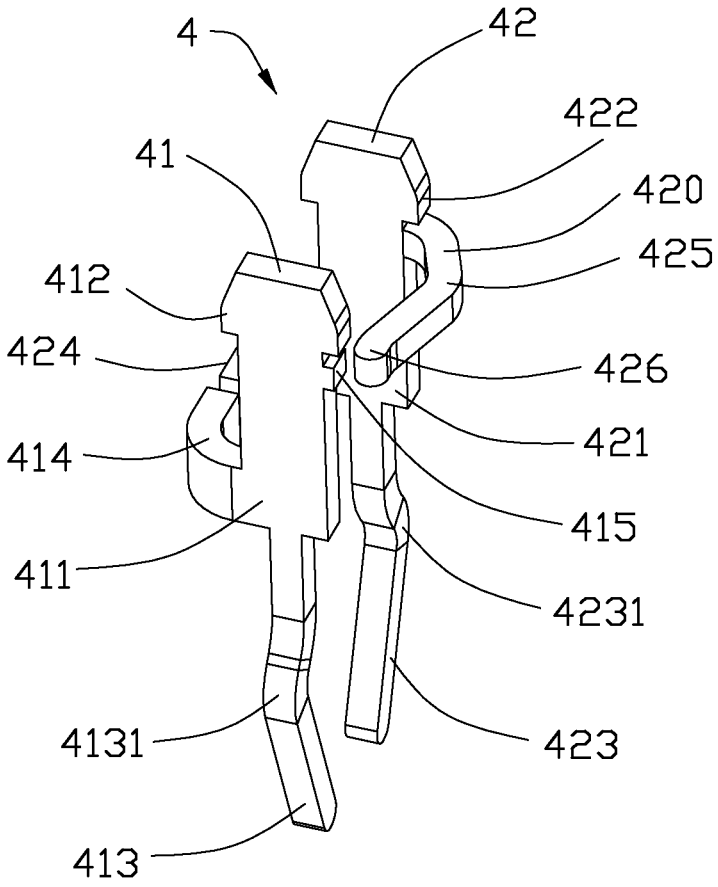
FIG. 3 is a perspective view of a pair of detecting terminals of the card edge connector of FIG. 2.
Figure 4:
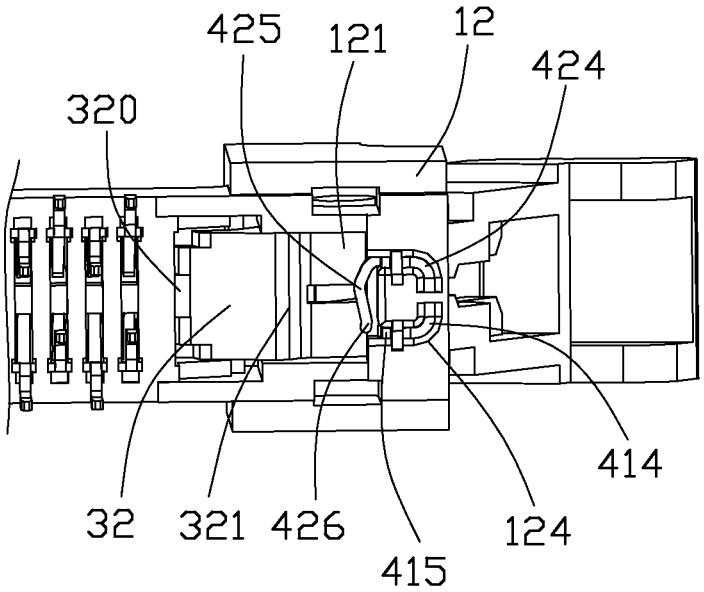
FIG. 4 is an enlarged part view of the card edge connector viewed from a bottom side thereof when detecting contacts are disengaging with each other.
Figure 5:
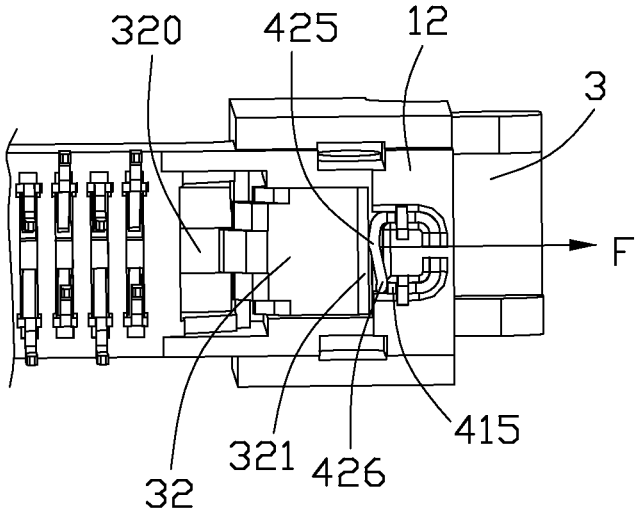
FIG. 5 is an enlarged part view of the card edge connector viewed from the bottom side thereof when the detecting contacts are engaging with each other.

Referring to FIGS. 3 to 5, the detecting contacts 4 are retained in the tower portion 12 and occupy original structure of the card edge connector 100, i.e. do not need change present lay-out on the PCB. The pair of detecting contacts 4 includes a first detecting pin 41 and a second detecting pin 42 both received in corresponding receiving slots 124 of the tower portion 12 and opening downwards for making the detecting contacts 4 being mounted upwards to the receiving slots 124. The first detecting pin 41 and the second detecting pin 42 are both bended from metal strips and are spring for being capable of engaging or disengaging with each other.

The first detecting pin 41 includes a main body 411 received in the tower portion 12, a retaining portion 412 extending from the main body 411 and positioned in the tower portion 12, a soldering tail 413 extending outwards from the main body 411 for positioning on the PCB, a positioning portion 414 extending from one side of the main body 411 for preventing the first detecting pin 41 from moving in the longitudinal direction and an second contact portion 415 extending from another side of the main body 411 and movable engaging with a spring engaging arm 420 formed by the second detecting pins 42.

The second detecting pins 42 has a similar structure and also defines a main body 421, a retaining portion 422, a soldering tail 423 and a positioning portion 424, except the above-mentioned spring engaging arm 420 extending one side of the main body 421 and being different from the engaging portion 415. The soldering tails 413, 423 both define an arc-shaped locking sections (respectively marked as 4131, 4231) for elastically extending through and steadily locking on the PCB. The spring engaging arm 420 includes an engaging portion 425 protruding into the insertion slot 101 and opposite to the pushing portion 32 of the ejector 3, a third contact portion 426 moveable contacting with and opposite to the second contact portion 415, i.e. the contact portion 426 engage or disengage with the second contact portion 415 because the engaging portion 425 moving along with the ejector 3.

The pushing portion 32 includes an inner section 320 extending towards the insertion slot 101 for engaging with the memory card in the opening station and an outer section 321 opposite to the inner section 320 and thus pressing on the engaging portion 425 of the second detecting pin 42 in the locking station. When the ejector 3 is turned outwards and disposed at the opening station in which the pushing portion 32 leaves the engaging portion, the second contact portion 415 and the third contact portion 426 are both in original status and disengage with each other, the memory card is permitted to insert into the insertion slot 101.

When the memory card is inserted into the insertion slot 101, the memory card pushes downwards the pushing portion 32 for driving the ejector 3 rotate to the locking station. The outer section 321 of the pushing portion 32 presses on the engaging portion 425 which moves and drives the third contact portion 426 engage with the second contact portion 415 because of a pressing force (marked as arrow F) generated by the pushing portion 32, the locking portion 34 presses on the memory card until the memory card is received in the insertion slot 101. The base portion 30 further defines a protruding tuber 301 engaging with the engaging recess 122 for locking the ejector 3 in the locking station. When the ejector 3 is again turned outwards, the memory card is pushed outwards by the inner section 320 of the pushing portion 32 which withdraws the pressing force F pressing on the second detecting pins 42. The second contact portion 415 and the third contact portion 426 disengage with each other again.

The PCB defines an LED light which electrically connects with the first detecting pin 41 and the second detecting pin 42, thereby forming a series circuit or a parallel circuit. If it is a series circuit, the first detecting pin 41 and the second detecting pin 42 form a switch controlling the LED light off or on. When the first detecting pin 41 and the second detecting pin 42 are connected, the LED light is turn on for telling user the memory card is inserted. Otherwise the LED light is turn off for telling user the memory card is taken out. If it is a parallel circuit, the first detecting pin 41 and the second detecting pin 42 are disposed on one divided circuit and work as a switch for making the LED light disposed on the other divided circuit be short or not, then controlling the LED light be on or off.

Figure 6:
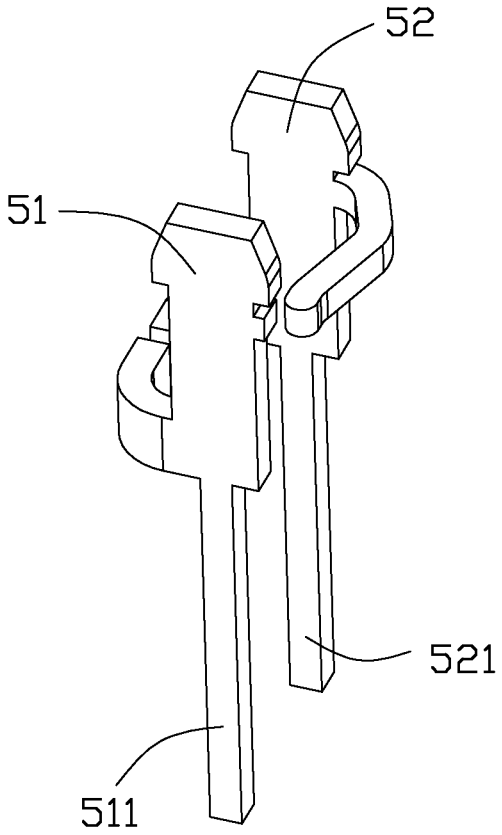
FIG. 6 is a perspective view of detecting contacts in accordance with another embodiment of the present invention.

Referring to FIG. 6, in another embodiment, a first detecting pin 51 and a second detecting pin 52 respectively defines a pin-shaped soldering tails 511, 521 different from the soldering tails 413, 423 in the first embodiment for easily being mounted in the PCB. The first detecting pin 51 and a second detecting pin 52 also worked as a switch in a series circuit or a parallel circuit for reminding user if the memory card is inserted or not.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. A card edge connector for engaging with a memory card, comprising:

a longitudinal insulative housing comprising a pair of sidewalls, an inserting slot therebetween for receiving the memory card and a receiving opening communicating with the inserting slot;

a plurality of contacts arranged two arrays along a longitudinal direction, respectively being disposed at the both sidewalls while opposite to each other in a width direction perpendicular to the longitudinal direction;

an ejector being mounted into the receiving opening and comprising a pushing portion extending towards the insertion slot from distal end thereof, the ejector movably engages with the insulative housing and thus moves between an opening station in which the memory card is permitted inserted into or pushed outwards and a locking station in which the memory card is positioned in the inserting slot; and at least one pair of detecting contacts comprising a first detecting pin and a second detecting pin received and retained in corresponding receiving slots formed by the insulative housing;

wherein the second detecting pin comprises a spring engaging arm having an engaging portion protruding to the insertion slot and opposite to the pushing portion which presses on the engaging portion in the locking station or leave the engaging portion in the opening station, thereby making the second detecting pin engage or disengage with the first detecting pin for detecting whether the memory card is inserted in the card edge connector or not.

2. The card edge connector as described in claim 1, wherein the first detecting pin and the second detecting pin both comprise a contacting portion connecting with each other, the contacting portion of the second detecting pin is disposed on distal end of the spring engaging arm which moves along the engaging portion.

3. The card edge connector as described in claim 2, wherein the contacting portion of the second detecting pin is disposed on outside of that of the first detecting pin.

4. The card edge connector as described in claim 1, wherein the pushing portion comprises an inner section extending towards the insertion slot for engaging with the memory card in the opening station and an outer section opposite to the inner section and thus engaging with the engaging portion of the second detecting pin in the locking station.

5. The card edge connector as described in claim 2, wherein the insulative housing comprises a pair of tower portions upwards integrally protruding from both ends of the sidewalls.

6. The card edge connector as described in claim 5, wherein the receiving slots is formed by the tower portion and open downwards for making the detecting contacts being mounted upwards therein.

7. The card edge connector as described in claim 5, wherein the ejector comprise a base portion, a pair of rotating shafts protruding from both sides of the base portion and pivoting in a pair of shaft hole formed by the tower portion, the pushing portion extending towards the insertion slot from one end of the base portion in the opening station for pushing the memory card outwardly, an operating portion disposed at distal end thereof and a locking portion disposed at opposite end of the operating portion and extending towards the insertion slot from another end of the base portion for locking the memory card.

8. A method of making a card edge connector mounting on a printed circuit board with a switch function thereof, comprising steps of:

providing an insulative housing with an elongated slot extending along a longitudinal direction;

providing a plurality of contacts in the housing beside said slot, each of said contacts including a contacting section extending into the slot and a tail section for mounting to the printed circuit board;

providing a tower portion at one end of the housing in said longitudinal direction;

providing an ejector in the tower portion, said ejector including an upper locker and a lower kicker for use with an upper notch and a lower edge of a memory module adapted to be received in the slot, said ejector moveable via rotation between an inner locking position and an outer ejecting position;

providing at least one detect pin around the tower portion with one tail for mounting to the printed circuit board; wherein when the ejector is moved to the outer position, the detect pin performs a first circuit path while when the ejector is moved to the inner locking position, the detect pin performs a second circuit path different from the first circuit path.

9. The method as claimed in claim 8, wherein the detect pin includes a part urged by the ejector when said eject pin is moved to the inner locking position.

10. The method as claimed in claim 9, further providing another detect pin spaced from the detect pin so as to establish the second circuit path.

11. The method as claimed in claim 10, wherein the detect pin and said another detect pin are space from each other in a transverse direction perpendicular to said longitudinal direction.

12. The method as claimed in claim 9, wherein said part is urged by a back side of the kicker when said ejector is moved to the locking position.

13. The method as claimed in claim 9, wherein said part is resilient.

14. A card edge connector for use with a memory card having an upper notch and a lower edge and with a printed circuit board, comprising:

an insulative housing defining an elongated slot extending along a longitudinal direction thereof for receiving said memory card;

a plurality of contacts disposed in the housing beside the slot, each of said contacts defining a contacting sections extending into the slot, and a mounting tail extending outside of the housing for mounting to the printed circuit board;

at least one tower portion located around at one end of the housing in said longitudinal direction;

at least one detect pin located around the tower portion and having a tail for mounting to the printed circuit board; and one ejector pivotally mounted in said tower portion and defining an upper locker for locking into the notch of the memory card and a lower kicker for ejecting the bottom edge of the memory card; wherein said ejector is rotatable between an inner locking position and an outer ejecting position, and the ejector physically pushes a part to actuate an electrical circuit path with regard to the detect pin when said ejector is located in the inner locking position, while said ejector is spaced from the part not to actuate said electrical circuit path when the ejector in the outer ejecting position.

15. The card edge connector as claimed in claim 14, wherein the part is unitarily formed with the detect pin.

16. The card edge connector as claimed in claim 14, wherein said part is of another detect pin located around the tower portion beside said detect pin in a separate manner when said ejector is in the ejecting position while said part is urged by the ejector to be mechanically and electrically connected to said detect pin when said ejector is moved to the locking position.

17. The card edge connector as claimed in claim 16, wherein said another detect pin defines a tail for mounting to the printed circuit board.

18. The card edge connector as claimed in claim 16, wherein said detect pin and said another detect pin are space from each other in a transverse direction perpendicular to said longitudinal direction.

19. The card edge connector as claimed in claim 16, wherein said ejector is rotatable about an axis extending in a transverse direction perpendicular to said longitudinal direction.

20. The card edge connector as claimed in claim 14, wherein a back end of the kicker urges the part when said ejector is moved to the locking position.

* * * * *